US012788193B2

(12) United States Patent
Wald et al.

(10) Patent No.: US 12,788,193 B2
(45) Date of Patent: Nov. 10, 2026

(54) METHOD OF CONTROLLING A FLOOR ROBOT HAVING A SIDE BRUSH AND FLOOR ROBOT

(71) Applicant: BSH Hausgeräte GmbH, Munich (DE)

(72) Inventors: Andreas Wald, Fulda (DE); Stefan Hassfurter, Maroldsweisach (DE); Frank Schnitzer, Bad Neustadt (DE)

(73) Assignee: BSH Hausegeräte GmbH, Munich (DE)

( * ) Notice: Subject to any disclaimer, the term of this patent is extended or adjusted under 35 U.S.C. 154(b) by 266 days.

(21) Appl. No.: 18/441,052

(22) Filed: Feb. 14, 2024

(65) Prior Publication Data

US 2024/0268613 A1 Aug. 15, 2024

(30) Foreign Application Priority Data

Feb. 14, 2023 (DE) ..... 10 2023 201 254.5

(51) Int. Cl.
*A47L 11/40* (2006.01)
*A47L 9/04* (2006.01)

(52) U.S. Cl.
CPC ..... *A47L 9/0488* (2013.01); *A47L 11/4011* (2013.01); *A47L 2201/04* (2013.01); *A47L 2201/06* (2013.01)

(58) Field of Classification Search
CPC ..... A47L 9/28; A47L 9/04; A47L 11/4066; A47L 11/4083
See application file for complete search history.

(56) References Cited

U.S. PATENT DOCUMENTS 10,433,697 B2 * 10/2019 Lindhé ..... G05D 1/0219
11,103,113 B2 * 8/2021 Schregardus ..... A47L 9/0488
2007/0234492 A1 * 10/2007 Svendsen ..... B25J 9/0003 15/49.1
2008/0276407 A1 * 11/2008 Schnittman ..... B60L 50/52 901/1
2010/0037418 A1 * 2/2010 Hussey ..... A47L 9/12 901/1
2013/0056032 A1 * 3/2013 Choe ..... G05D 1/0038 15/3
2015/0120056 A1 * 4/2015 Noh ..... B25J 9/1676 901/1
2015/0375395 A1 * 12/2015 Kwon ..... H02J 7/50 901/30
2018/0206686 A1 7/2018 Shigeto et al.
(Continued)

FOREIGN PATENT DOCUMENTS

CN 107411638 A 12/2017
CN 108852184 A 11/2018
(Continued)

*Primary Examiner* — Michael D Jennings
(74) *Attorney, Agent, or Firm* — Laurence A. Greenberg; Werner H. Stemer; Ralph E. Locher

(57) ABSTRACT

A method controls a floor robot for cleaning a floor area. The floor robot contains a side brush that is rotatable about a vertical axis and has at least one flexible cleaning arm that is guided over the floor area with a rotation of the side brush. The method includes the following steps of: the floor robot approaching a corner, so that the side brush lies in the corner; varying a rotational speed of the side brush while the floor robot is at a standstill; and steering the floor robot out of the corner.

11 Claims, 4 Drawing Sheets

(56) References Cited

U.S. PATENT DOCUMENTS

| | | | | |
|---|---|---|---|---|
| 2018/0338655 | A1 | 11/2018 | Schregardus et al. | |
| 2022/0083074 | A1* | 3/2022 | Ferrer | G05D 1/0253 |

FOREIGN PATENT DOCUMENTS

| | | | |
|---|---|---|---|
| DE | 102014105330 | A1 | 10/2015 |
| EP | 3205250 | A1 | 8/2017 |
| EP | 3082541 | B1 | 4/2018 |
| JP | 3344079 | B2 | 11/2002 |
| JP | 2014079514 | A | 5/2014 |
| JP | 2016077854 | A | 5/2016 |

* cited by examiner

METHOD OF CONTROLLING A FLOOR ROBOT HAVING A SIDE BRUSH AND FLOOR ROBOT

CROSS-REFERENCE TO RELATED APPLICATION

This application claims the priority, under 35 U.S.C. § 119, of German Patent Application DE 10 2023 201 254.5, filed Feb. 14, 2023; the prior application is herewith incorporated by reference in its entirety.

FIELD AND BACKGROUND OF THE INVENTION

The invention relates to the control of a side brush of a floor robot. In particular, the invention relates to the control of the side brush in a corner of a floor area to be cleaned.

A floor robot is configured to clean a floor area. A side brush can be provided for improved cleaning along an edge or a groove between the floor surface and a lateral boundary, such as a wall or a piece of furniture. The side brush is usually attached to the front and side of the floor robot and can be rotated about a vertical axis. The side brush contains cleaning arms that are guided over the floor area with the rotation of the side brush in order to move dirt out of the edge and preferably into a receiving area of the floor robot. The receiving area can be formed by a suction mouth through which air and dirt can be sucked in.

If the floor robot drives into a corner where the floor area and two lateral boundaries are adjacent to each other, the side brush should also sweep out dirt there. For this purpose, the cleaning arms are chosen to be sufficiently long so that they reach all the way into the corner.

European patent EP 3 082 541 B1, corresponding to U.S. Pat. No. 10,433,697, proposes an adapted speed control of a rotating side brush on a floor robot. In this case, the rotational speed of the side brush can be controlled in dependence upon a driving speed of the floor robot.

SUMMARY OF THE INVENTION

It has been shown that a cleaning effect by the side brush in a corner is often not satisfactory and often dirt remains in the corner. One object of the present invention is to specify an improved technique for cleaning a corner by means of a floor robot with a side brush. The invention achieves this object by means of the subjects of the independent claims. Subordinate claims reflect preferred embodiments.

A floor robot for cleaning a floor area contains a side brush that is rotatable about a vertical axis and has at least one flexible cleaning arm that is guided over the floor area with a rotation of the side brush. According to a first aspect of the present invention, a method for controlling such a floor robot comprises steps of the floor robot approaching a corner so that the side brush lies in or is positioned in the corner; varying a rotational speed of the side brush while the floor robot is at a standstill; and steering the floor robot out of the corner.

The cleaning arm can comprise, for example, a fiber bundle or a flexible arm, for example made of plastic or rubber, and is preferably sufficiently long to penetrate completely into the corner. It was recognized that the cleaning arm cannot do this if it is guided too quickly over the floor area. The cleaning arm can be bent on the wall against the direction of rotation. In order to stretch sufficiently straight if it can thrust into the corner, the rotational speed must not be too high in order to give the cleaning arm enough time to relax so that it becomes straight and reaches the boundary of the corner.

It is proposed to vary the rotational speed while the floor robot is at a standstill, so that especially the cleaning of the floor area in the corner is improved. A variation is understood herein to mean a temporary change. Rotational speeds before and after the variation can be the same or can be controlled on the basis of the same parameters. During the variation, the rotational speed deviates from that before or after. As explained in more detail below, a variation can include temporarily assuming a predetermined rotational speed once; however, the rotational speed can also be successively controlled to different values in a predetermined sequence.

The approach can contain driving along a lateral boundary of the floor area, wherein the side brush is facing the boundary. The boundary is usually formed by a wall or an object such as a floor strip, a piece of furniture or a household object. Usually, the boundary runs straight but a horizontally curved course is also possible.

In order to clean an edge between the floor surface and a lateral boundary, the rotational speed can be controlled in dependence upon a driving speed of the floor robot. If the floor robot drives over a free section of the floor area, the rotational speed can be controlled according to a different heuristic. For example, the rotational speed can also be controlled in dependence upon the driving speed but can generally be higher than in the case of cleaning the edge. For the proposed technology, independent control of the rotational speed and the driving speed is generally required.

The varying can comprise temporarily reducing the rotational speed. This can give the cleaning arm the opportunity to penetrate further into the corner and thus improve the thorough cleaning of the floor area in the area of the corner.

The rotational speed can be varied in steps or continuously. In this case, a temporary increase or decrease in the rotational speed or a sequence of different rotational speeds can be controlled. In one embodiment, the rotational speed is successively increased and decreased, or vice versa, with respect to the value that is applicable outside of the variation.

The rotational speed can be reduced when the floor robot is at a standstill and the reduction can be ended prior to the end of the standstill. This simple embodiment can cause an adapted cleaning of the corner while the floor robot is at a standstill. For example, the rotational speed can be controlled once to a predetermined value while at a standstill. A duration during which the rotational speed is reduced can be predetermined. In this embodiment, it is not possible to influence the control of the rotational speed of the side brush outside of the standstill.

In another embodiment, the rotational speed can be reduced prior to the floor robot being at a standstill and the reduction can be ended prior to the end of the standstill. The floor robot can approach the corner at a reduced speed and stop at a predetermined distance from the corner. By reducing the rotational speed even before the stop, the reduced driving speed can be taken into account and used in the control of the rotational speed. Preferably, a first reduction takes place while the floor robot is approaching the corner at low speed, and a second while the floor robot is at a standstill. The rotational speed during the second reduction can be lower than during the first reduction.

The rotational speed can also be varied multiple times in succession. Dirt that has been swept out of the corner at a reduced rotational speed can be collected better when back at an increased rotational speed. By repeatedly controlling different rotational speeds, the dirt can be removed from the floor surface in an overall improved manner.

The variation can contain a temporary reversal of a direction of rotation of the side brush. When changing the direction of rotation of the side brush, the cleaning arm can be pressed into the corner in an improved manner. In the direction of rotation before and after the corner, the cleaning arm can be bent at one of the lateral boundaries. When reversing the direction of rotation, the cleaning arm can be "thrust" into the corner so that dirt can be swept out of the corner even better.

The side brush is attached to a right-hand or left-hand side of the floor robot, preferably as far forward as possible. A direction of rotation is preferably selected so that a driving speed of one end of the cleaning arm is increased relative to the floor surface during forward travel of the floor robot if the cleaning arm projects in the direction in which the side brush is laterally offset on the floor robot, and is reduced if it is oriented in the opposite direction. In other words, while the floor robot is driving forwards, the side brush preferably rotates counterclockwise when the side brush is attached on the right-hand side and clockwise when it is attached on the left-hand side. A rotation in this direction can be interpreted as a positive rotational speed, wherein a rotation in the opposite direction can be understood as a negative rotational speed.

Optionally, a further variation of the rotational speed is controlled while the floor robot is steered out of the corner. If the floor robot has a circular base area, it can be rotated and continued after cleaning the corner. In particular, if the floor robot has a D-shaped base, it can be necessary to reset the floor robot after cleaning the corner before it can be rotated. During this phase, dirt that has already been released from the corner can be collected better by further varying the rotational speed. In a further embodiment, the floor cleaner can drive into the corner multiple times in succession, wherein rotational speeds of the side brush are selected differently.

According to a further aspect of the present invention, a floor robot contains a side brush that is rotatable about a vertical axis and has a flexible cleaning arm that is configured so as to be guided over the floor area; and a control apparatus that is configured so as to control the floor robot according to a method that is described herein.

The control apparatus can be configured so as to implement in whole or in part a method that is described herein. For this purpose, the control apparatus can comprise an electronic processing facility that contains, for example, a programmable microcomputer or microcontroller. The method can be in the form of a computer program product having program code means. The computer program product can also be stored on a computer-readable data carrier. Features or advantages of the method can be transferred to the apparatus or vice versa.

The cleaning arm can comprise fibers made of rubber. In contrast to thin synthetic fibers, these can be more resistant to kinking or sustained bending. Although rubber fibers can assume their initial shape somewhat more slowly than synthetic fibers after bending, the described variation of the rotational speed of the side brush cannot cause any disadvantage.

Other features which are considered as characteristic for the invention are set forth in the appended claims.

Although the invention is illustrated and described herein as embodied in a control of a floor robot having a side brush, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
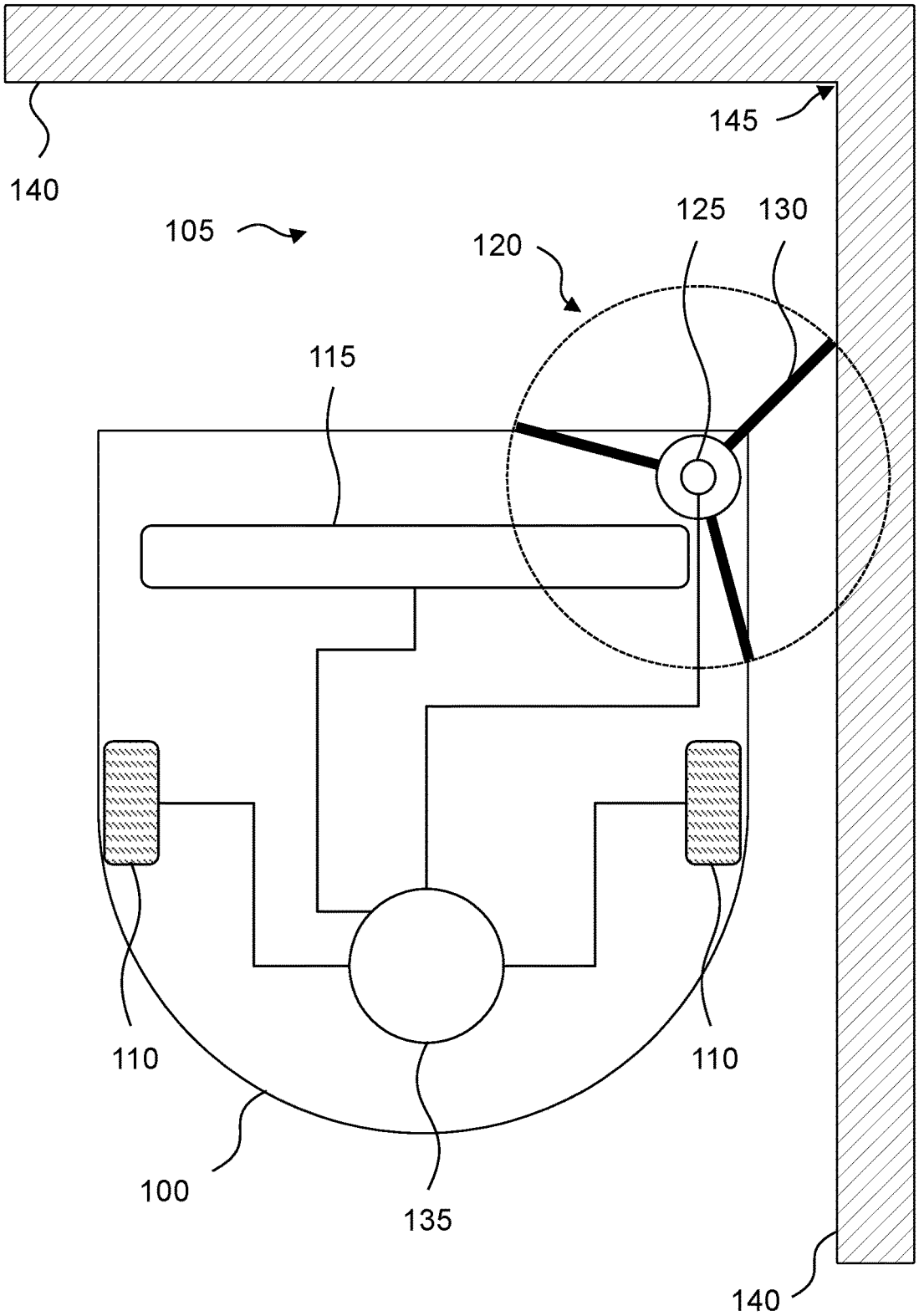
FIG. 1 is an illustration of a floor robot.

Referring now to the figures of the drawings in detail and first, particularly to FIG. 1 thereof, there is shown a floor robot 100 that is configured so as to clean a floor area 105. The floor robot 100 is illustrated schematically and in a view from below. A base area of the floor robot 100 is, for example, D-shaped. In the present case, two drive wheels 110 are provided for moving the floor robot 100 over the floor area 105. Dirt can be sucked off the floor surface 105 through a suction mouth 115. A suction unit for causing an air flow through the suction mouth 115 and a filter for separating sucked-in dirt are not illustrated.

A side brush 120 is attached to the front of the floor robot 100 at the side and preferably in the direction of travel. The side brush 120 contains a central body having a plurality of cleaning arms 130, which can be guided over the floor area 105 in a rotational movement about an essentially vertical axis of rotation. For this purpose, the side brush 120 contains a drive motor 125, and it is possible to control the rotational speed of said drive motor about the rotational axis. In the illustrated embodiment, three cleaning arms 130 are provided by way of example, each of which is attached to the central body on one side and is distributed uniformly in the circumferential direction with respect to the axis of rotation. The cleaning arms 130 can be inclined slightly downward, so that their free ends are pressed slightly against the floor area 105. A circle with a broken line indicates a range of the cleaning arms 130 that are just protruding. If the floor robot 100 approaches a boundary 140, the cleaning arms 130 can be bent counter to their direction of rotation during their rotation about the axis of rotation.

A cleaning arm comprises a number of fibers, which are combined on one side and are fastened to the central body that is driven by the drive motor 125. The fibers can be produced, for example, from a plastic (synthetic) or rubber. Fibers made of rubber are usually somewhat thicker and somewhat more resistant to sustained deformation than those made of synthetic material. In addition, a fiber made of rubber can have a reduced abrasion and thus an extended service life.

Components of the floor robot 100 can preferably be controlled by means of a control apparatus 135. The control apparatus 135 preferably operates in a conventional manner by performing a movement of the floor robot 100 over the floor area 105 in dependence upon boundaries 140 of the floor area 105 and objects located thereon. For this purpose, the control apparatus 135 can comprise a map memory that comprises map information about a household in which the floor area lies. In addition, a sensor can be provided for scanning an environment, so that an object that is located in the environment can be detected.

Figure 2:
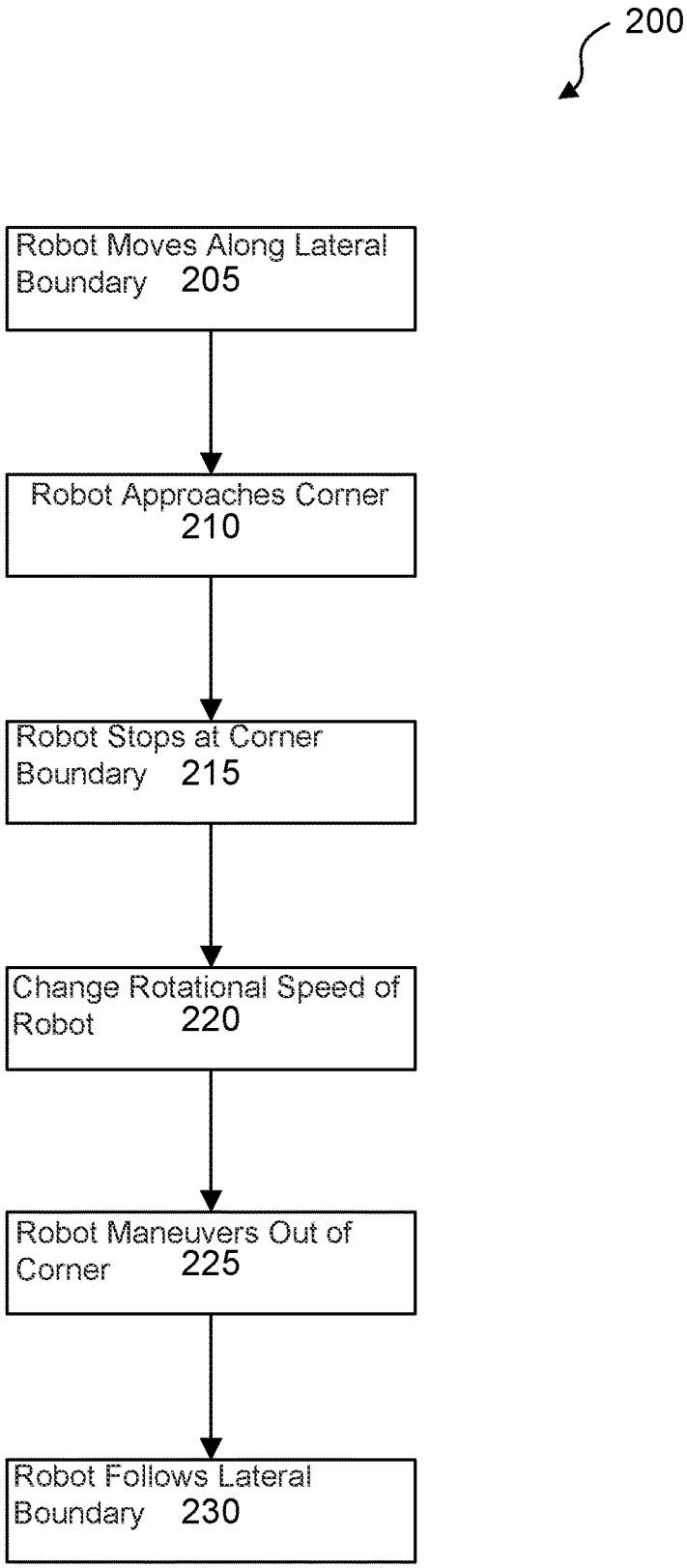
FIG. 2 is a flowchart of a method for controlling a floor robot.

FIG. 2 illustrates a flowchart of a method 200 for controlling a floor robot 100. The method 200 can be implemented by means of a floor robot 100 or by its control apparatus 135.

In a step 205, the floor robot 100 drives along a lateral boundary 140 of the floor area 105. This journey can be part of a strategy to traverse a perimeter of the floor area 105. In this case, the side brush 120 lies on a side that is facing the boundary 140. A lateral distance from the boundary 140 is preferably small and, in an exemplary embodiment, can be approximately 5-10 mm. In general, the distance is less than the maximum distance of one end of a cleaning arm 130 in the lateral direction, so that the rotating cleaning arm 130 sweeps along the lateral boundary 140, wherein the cleaning arm is deformed from a straight to a curved shape. In this case, an edge or groove that is formed between the floor area 105 and the boundary 140 can be cleaned of dirt. A further distance between the vertical axis of the side brush 120 and the boundary 140 can, in an exemplary embodiment, be approximately 25-30 mm.

In the embodiment illustrated in FIG. 1 with the side brush 120 arranged on the right-hand side in the direction of travel, the floor robot 100 would thus traverse the boundaries 140 in the counterclockwise direction. In this case, the side brush 120 rotates counterclockwise in order to throw dirt that lies laterally at the boundary 140 forward and in the direction of the axis of movement of the floor robot 100, where it can be sucked up by the suction mouth 115.

In a step 210, the floor robot 100 can approach a corner 145 where, from the viewpoint of the floor robot 100, a lateral boundary and a boundary 140 that lies in the direction of travel adjoin one another. In this case, the floor robot can reduce its driving speed and finally stop completely in a step 215 when it has reached a predetermined distance from the front boundary 140. This distance can be selected to be similar to that to the lateral boundary 140 and is generally so small that a rotating cleaning arm 130 also sweeps along the front boundary 140, wherein the cleaning arm is bent. In this case, an edge or groove that is formed between the floor area 105 and the boundary 140 can be cleaned of dirt.

The position in which the floor robot 100 stops at the corner 145 is further preferably selected such that a cleaning arm 130 can completely thrust into the corner 145 if it is in a suitable rotational position about the axis of rotation and the cleaning arm projects straight from the axis of rotation. The position can also be selected such that the cleaning arm 130 can already completely reach the corner 145 if it is slightly bent.

In a step 220, the rotational speed of the side brush 120 can be temporarily changed and in particular reduced. Different speed profiles are conceivable, which are described in more detail, for example, with reference to FIG. 3. The temporary change can improve the ability of a cleaning arm 130 to completely thrust into the corner 145 and to sweep dirt out of it.

In a step 225, the floor robot 100 can be maneuvered out of the corner 145. If the floor robot 100 has a round base area, it can be rotated in such a manner that it does not change its position and does not collide with one of the boundaries 140. If the floor robot 100 has a different shape, it can be necessary to first drive it backwards and only then initiate a curve. Depending on the basic shape of the floor robot, different approaches are common here.

In a step 230, the floor robot 100 can then follow the now lateral boundary 140 and further clean the outer edge of the floor area 105.

Figure 3:
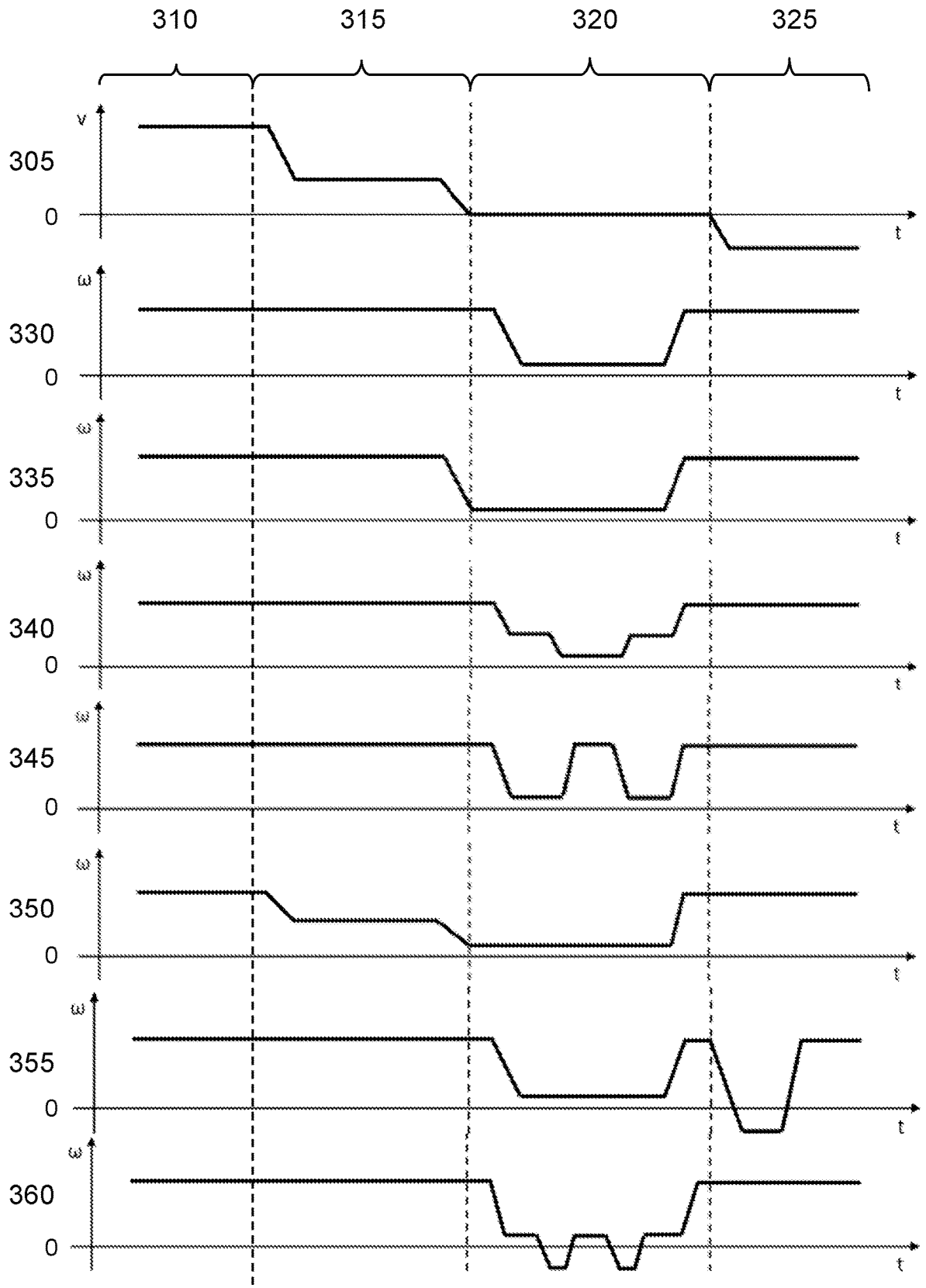
FIG. 3 is a graph showing speed profiles of the floor robot.

FIG. 3 illustrates speed profiles on a floor robot 100. A first profile 305 illustrates a profile of a driving speed of the floor robot. The speed v is plotted in the vertical direction and the time t is plotted in the horizontal direction.

The illustrated movement of the floor robot 100 is divided into four phases. In a first phase 310, the floor robot 100 drives on the floor area 105, in particular in the manner of step 205 of the method 200. In a second phase 315, the floor robot 100 approaches a corner 145, for example in the manner of step 210. In this case, the driving speed of the floor robot 100 is reduced. In a third phase 320, the floor robot 100 is at a standstill in a predetermined position relative to the corner 145, cf. steps 215 and 220. In a fourth phase 325, the floor robot 100 is maneuvered out of the corner 145 according to step 225.

The illustrated phases 310-325 are common to virtually all types of floor robots 100; however, it should be noted that the fourth phase 325 can be adapted to the shape of the floor robot 100. In the present case, the fourth phase 325 comprises, purely by way of example, a short reverse drive. It should also be noted that the specifically illustrated profiles of the driving speeds in the individual phases 310-325 are exemplary.

It is proposed to vary a rotational speed of a side brush 120 while the floor robot 100 is at a standstill in the third phase 320. In some embodiments, the rotational speed can be changed earlier or the change can be ended later. For this purpose, seven exemplary profiles 330-360 of rotational speeds are recorded. The time is plotted in the horizontal direction and a rotational speed ω of the side brush 120 is plotted in the vertical direction. Heuristics that form the basis of the individual profiles 330-360 can be combined with one another in order to yield a new profile.

According to a first profile 330, the rotational speed is temporarily decreased while the floor robot 100 is at a standstill in the third phase 320. The decrease begins after the floor robot 100 has reached the standstill and ends before it starts again in the fourth phase 325. In this case, the rotational speed is decreased to a predetermined extent.

According to a second profile 335, the start of the decrease compared to the first profile 330 is drawn forward in time into the second phase 315. An acceleration of the rotational speed is preferably limited, as can be seen from the uniform steepness of transitions between different rotational speeds in FIG. 3. It is preferred that the decrease in the second phase 315 begins so that a predetermined, decreased rotational speed is assumed when the floor robot 100 is at a standstill in the third phase 320. For example, the decrease in the rotational speed can be started as soon as the driving speed of the floor robot 100 with a predetermined acceleration has begun to be reduced to zero.

According to a third profile 340, the decrease takes place in stages. At first, the rotational speed is reduced to a first value and then further to a second value. The reduction can be ended directly or indirectly by increasing the rotational speed to the first value as illustrated before the decrease is ended. In contrast to what is illustrated, three, four or even more differently sized values can also be provided. A transition between the values can also be controlled continuously.

According to a fourth profile 345, a plurality of decreases are successively controlled. Between the decreases, the rotational speed can be increased to the value that is applicable outside the third phase 320 or to another predetermined value.

According to a fifth profile 350, the rotational speed is controlled in dependence upon the driving speed of the floor robot 100. If the driving speed of the floor robot decreases as it approaches the corner 145, the rotational speed can be reduced to an extent that is derived therefrom. The decrease is preferably ended before the floor robot 100 is set in motion again in the fourth phase 325. In the fourth phase 325, the rotational speed cannot be dependent on the driving speed.

According to a sixth profile 355, a decrease in the rotational speed is controlled in a manner similar to that in the first profile 330. In contrast, however, the rotational speed can be temporarily decreased again during the fourth phase 325. The decrease can take place to such an extent that the drive motor 125 temporarily rotates backwards.

According to a seventh profile 360, a decrease according to the first profile 330 is also controlled but the direction of rotation of the drive motor 125 can be briefly reversed while the floor robot 100 is at a standstill. In the illustrated embodiment, the rotational speed is decreased to below zero twice, so that a total of four reversals of the rotational direction take place. In other embodiments, only one or more than two decreases below zero can also be provided.

Figure 4:
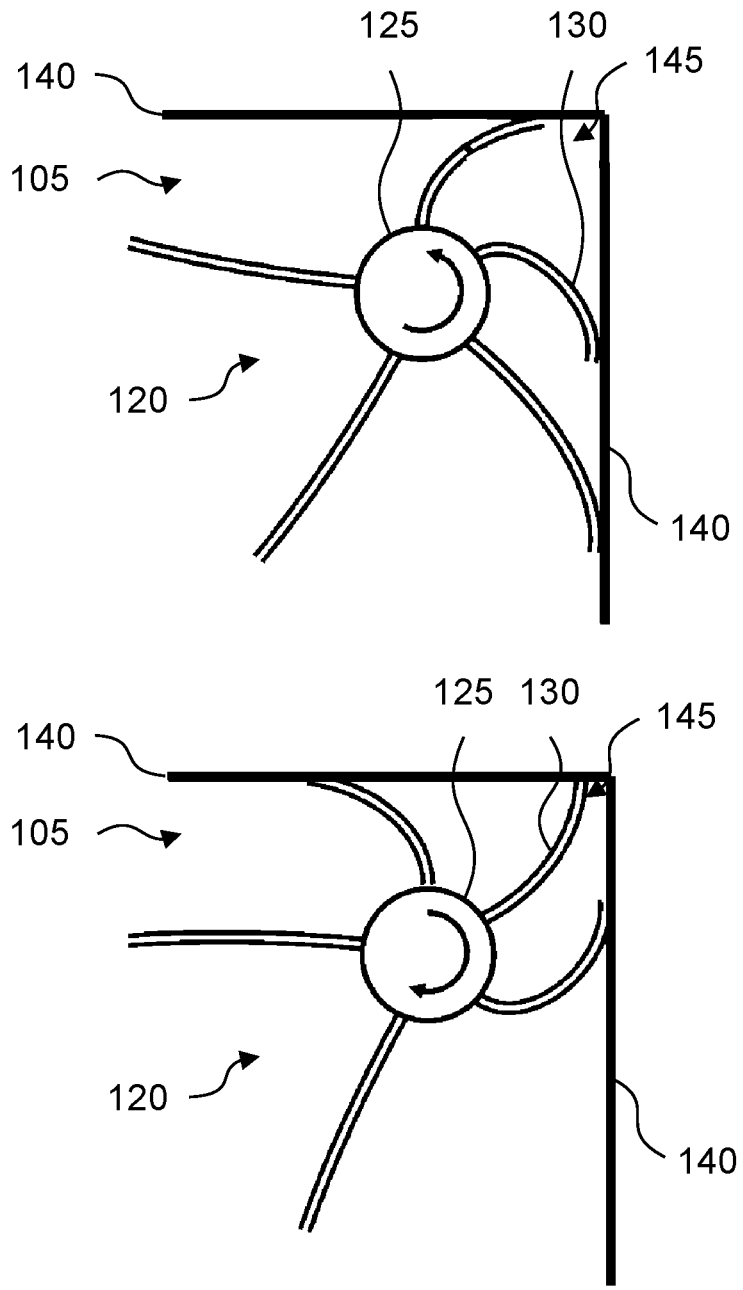
FIG. 4 is an illustration showing deflected cleaning arms on a side brush.

FIG. 4 illustrates deflected cleaning arms 130 on a side brush 120 in a schematic and exemplary embodiment. A direction of rotation of the side brush 120 is illustrated on the drive motor 125: in an upper illustration in the counterclockwise direction and in a lower illustration in the clockwise direction.

The cleaning arms 130 are guided over the floor area 105 by the rotational movement and are deflected or bent at the boundaries 140. If a rotational speed of the side brush 120 is too high, a cleaning arm 130, having lost contact with one boundary 140 during a rotation and having not yet made contact with the other boundary 140, does not have sufficient time to relax from the bent shape into an unloaded, molded shape. This shape is preferably straight, so that the cleaning arm 130 lies on a radius through the axis of rotation. For this reason, the cleaning arm 130 cannot completely penetrate into the corner 145 between the boundaries 140.

The penetration can be facilitated by reversing the direction of rotation of the side brush 120, because then there is usually at least one cleaning arm 130 on the side brush 120, which can unwind particularly far into the corner 145 at the beginning of the reverse rotation. This effect can be intensified by changing the direction of rotation several times. Dirt that is thrown out of the corner 145 can then be sucked up by the floor robot 100. For this purpose, it can be necessary to vacuum two areas into which the dirt has been thrown under the different directions of rotation.

The following is a summary list of reference numerals and the corresponding structure used in the above description of the invention.

REFERENCE CHARACTERS

100 System
105 Floor area
110 Drive wheel
115 Suction mouth
120 Side brush
125 Drive motor
130 Cleaning arm
135 Control apparatus
140 Boundary
145 Corner
200 Method
205 Driving along wall
210 Approaching corner
215 Standstill in corner
220 Temporarily changing the rotational speed of the side brush
225 Driving out of corner
230 Continuing
305 Speed profile
310 First phase
315 Second phase
320 Third phase
325 Fourth phase
330 First profile of a rotational speed
335 Second profile of a rotational speed
340 Third profile of a rotational speed
345 Fourth profile of a rotational speed
350 Fifth profile of a rotational speed
355 Sixth profile of a rotational speed
360 Seventh profile of a rotational speed
ω Rotational speed
v Driving speed
t Time

The invention claimed is:

1. A method for controlling a floor robot for cleaning a floor area, the method comprising the steps of:

providing the floor robot for cleaning the floor area, the floor robot having a side brush being rotatable about a vertical axis, the side brush having at least one flexible cleaning arm being guided over the floor area with a rotation of the side brush, the at least one flexible cleaning arm having fibers made of rubber;

moving the floor robot, upon approaching a corner, so that the side brush lies in the corner;

varying a rotational speed of the side brush while the floor robot is at a standstill; and steering the floor robot out of the corner.

2. The method according to claim 1, wherein the moving step includes driving along a lateral boundary of the floor area, wherein the side brush is facing the lateral boundary.

3. The method according to claim 2, which further comprises controlling the rotational speed of the side brush while driving along in dependence upon a driving speed of the floor robot.

4. The method according to claim 1, wherein the varying of the rotational speed of the side brush step further includes temporarily reducing the rotational speed.

5. The method according to claim 4, which further comprises varying the rotational speed in stages.

6. The method according to claim 1, wherein the rotational speed is reduced when the floor robot is at the standstill, and a reduction in the rotational speed is ended prior to an end of the standstill.

7. The method according to claim 1, wherein the rotational speed is reduced prior to the floor robot being at the standstill and a reduction in the rotational speed is ended prior to an end of the standstill.

8. The method according to claim 1, wherein the rotational speed is varied multiple times in succession.

9. The method according to claim 1, wherein a variation of the rotational speed includes temporary reversal of a direction of rotation of the side brush.

10. The method according to claim 1, wherein a further variation of the rotational speed is controlled while the floor robot is steered out of the corner.

11. A floor robot, comprising:

a side brush being rotatable about a vertical axis and having at least one flexible cleaning arm being configured so as to be guided over a floor area with a rotation of the side brush, said at least one flexible cleaning arm has-having fibers made of rubber; and a controller configured to control the floor robot to:

move the floor robot, upon approaching a corner, so that the side brush lies in the corner;

vary a rotational speed of the side brush while the floor robot is at a standstill; and steer the floor robot out of the corner.

* * * * *